US006907803B2

(12) United States Patent
Tuan-Mu

(10) Patent No.: US 6,907,803 B2
(45) Date of Patent: Jun. 21, 2005

(54) SINGLE-DIRECTION OPERATION TYPE RATCHET WRENCH STRUCTURE

(75) Inventor: Hsien-Chung Tuan-Mu, Taichung (TW)

(73) Assignee: Easco Hand Tools, Inc., Simsbury, CT (US)

( * ) Notice: Subject to any disclaimer, the term of this patent is extended or adjusted under 35 U.S.C. 154(b) by 81 days.

(21) Appl. No.: 10/092,596

(22) Filed: Mar. 8, 2002

(65) Prior Publication Data

US 2003/0075024 A1 Apr. 24, 2003

(30) Foreign Application Priority Data

Oct. 23, 2001 (TW) ..... 90218224 U

(51) Int. Cl.[7] ..... B25B 13/46
(52) U.S. Cl. ..... 81/60; 81/61; D8/25
(58) Field of Search ..... 81/80, 61; D8/25

(56) References Cited

U.S. PATENT DOCUMENTS 588,438 A * 8/1897 Johnson et al. ..... 81/DIG. 5
1,748,218 A * 2/1930 Groves ..... 81/DIG. 5
3,337,014 A * 8/1967 Sandrick ..... 81/DIG. 5
4,333,366 A * 6/1982 Hurtig ..... 81/DIG. 5
5,495,783 A * 3/1996 Slusar et al. ..... 81/DIG. 5
D470,369 S * 2/2003 Byram et al. ..... D8/25

FOREIGN PATENT DOCUMENTS

| | | |
|---|---|---|
| TW | 82210886 | 2/1995 |
| TW | 87207075 | 6/1999 |
| TW | 88204777 | 11/1999 |

* cited by examiner

*Primary Examiner*—James G. Smith
(74) *Attorney, Agent, or Firm*—Rosenberg, Klein & Lee

(57) ABSTRACT

A single-direction operation type ratchet wrench structure includes an elongated handle, and an identification portion. The handle has one end provided with a socket end, and a ratchet wheel is mounted in the socket end and operated in one direction only. The identification portion is mounted on the handle, and mates with a rotation direction of the ratchet wheel for locking or unlocking a workpiece, so that when a user holds the handle of the single-direction operation type ratchet wrench structure, he may directly identify the correct rotation direction for locking or unlocking the workpiece by the location and the direction of the identification portion on the handle, thereby facilitating the user operating the single-direction operation type ratchet wrench structure.

12 Claims, 8 Drawing Sheets

SINGLE-DIRECTION OPERATION TYPE RATCHET WRENCH STRUCTURE

BACKGROUND OF THE INVENTION

1. Field of the Invention

The present invention relates to a single-direction operation type ratchet wrench structure, and more particularly to a single-direction operation type ratchet wrench structure that may enhance convenience of operation.

2. Description of the Related Art

A conventional single-direction operation type ratchet wrench in accordance with the prior art may be used to operate a workpiece, such as a nut, a bolt or the like, to rotate along one direction only. Thus, the conventional single-direction operation type ratchet wrench may drive the workpiece to rotate in the clockwise direction so as to lock the workpiece. The conventional single-direction operation type ratchet wrench may be inverted to drive the workpiece to rotate in the counterclockwise direction so as to unlock the workpiece.

However, the user cannot identify the correct rotation direction of the conventional single-direction operation type ratchet wrench, so that the user has to mount the conventional single-direction operation type ratchet wrench on the workpiece to test the correct rotation direction of the conventional single-direction operation type ratchet wrench for locking or unlocking the workpiece, thereby causing inconvenience to the user.

SUMMARY OF THE INVENTION

The present invention has arisen to mitigate and/or obviate the disadvantage of the conventional single-direction operation type ratchet wrench.

The primary objective of the present invention is to provide a single-direction operation type ratchet wrench structure that may enhance convenience of operation.

Another objective of the present invention is to provide a single-direction operation type ratchet wrench structure, wherein when the user holds the handle of the single-direction operation type ratchet wrench structure, he may directly identify the direction of operation for locking or unlocking the workpiece through tactile touch based on the identification portion on the handle, without having to test the direction of operation for locking or unlocking the workpiece, thereby facilitating the user operating the handle of the single-direction operation type ratchet wrench structure.

In accordance with the present invention, there is provided a single-direction operation type ratchet wrench structure, comprising:

- an elongated handle having one end provided with a socket end, and a ratchet wheel mounted in the socket end and operated in one direction only; and
- an identification portion mounted on the handle, for identifying the rotating direction of the single-direction operation type ratchet wrench structure for locking or unlocking a workpiece, so that when a user holds the handle of the single-direction operation type ratchet wrench structure, he may directly identify the correct rotation direction for locking or unlocking the workpiece through tactile touch based on the identification portion on the handle.

Further benefits and advantages of the present invention will become apparent after a careful reading of the detailed description with appropriate reference to the accompanying drawings.

DETAILED DESCRIPTION OF THE INVENTION

Figure 1:
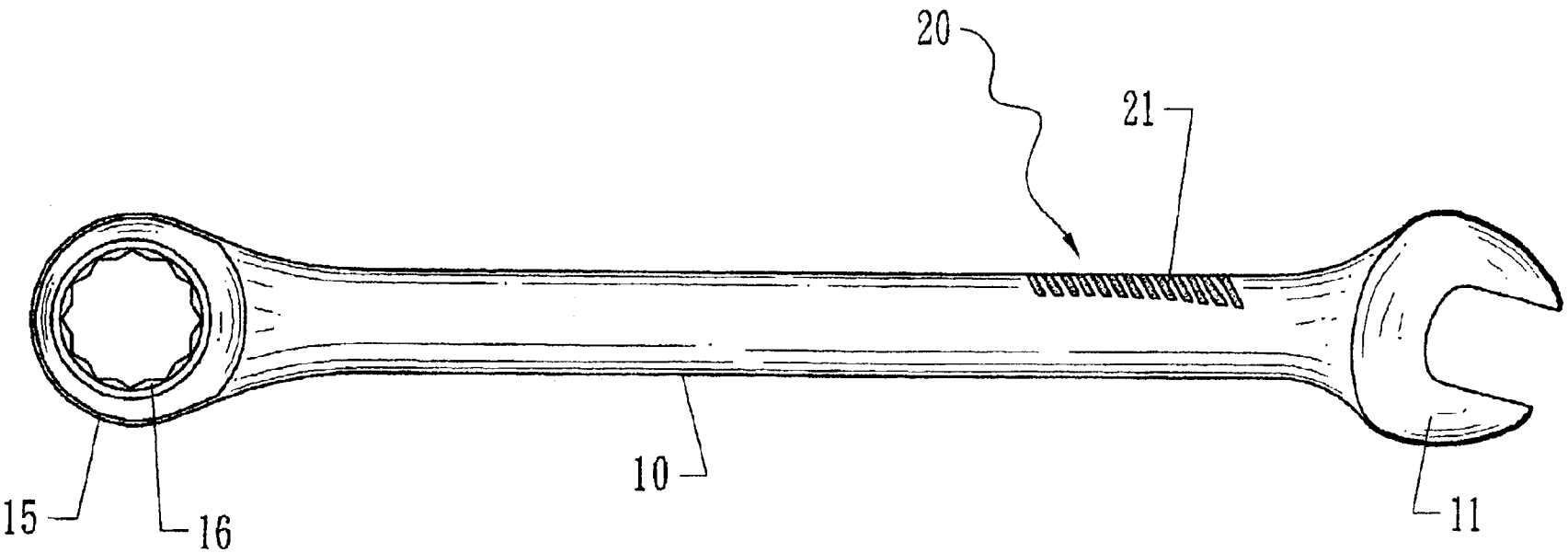
FIG. 1 is a plan view of a single-direction operation type ratchet wrench structure in accordance with a first embodiment of the present invention.

Referring to the drawings and initially to FIG. 1, a single-direction operation type ratchet wrench structure in accordance with a preferred embodiment of the present invention comprises an elongated handle 10 having a first end provided with an opened end 11 and a second end provided with a socket end 15. A ratchet wheel 16 is mounted in the socket end 15 of the handle 10 and may be operated in one direction only, so that the user may use the ratchet wheel 16 of the socket end 15 of the handle 10 to rotate and lock a workpiece, such as a nut or the like, and may invert the ratchet wheel 16 of the socket end 15 of the handle 10 to rotate and unlock the workpiece.

The single-direction operation type ratchet wrench structure in accordance with the preferred embodiment of the present invention further comprises an identification portion 20 mounted on a side edge of the handle 10 and mated with a rotation direction of the ratchet wrench structure for locking or unlocking a workpiece, so that when a user holds the handle 10 of the single-direction operation type ratchet wrench structure, he may directly identify the correct rotation direction for locking or unlocking the workpiece by the location and the direction of the identification portion 20 on the handle 10.

The identification portion 20 maybe located adjacent to the opened end 11 or the socket end 15 of the handle 10, so as to correspondingly indicate the operation direction of the ratchet wheel 16 of the socket end 15 of the handle 10 of the single-direction operation type ratchet wrench structure.

The identification portion 20 may be provided with concave streaks or convex streaks formed on or bonded on the side edge of the handle 10 and located adjacent to the opened end 11 or the socket end 15 of the handle 10.

As shown in FIG. 1, the identification portion 20 includes multiple serially arranged upper oblique streaks 21 each directed toward a direction opposite to the socket end 15 of the handle 10.

In operation, when the identification portion 20 is located at the top edge of the handle 10, the handle 10 may be rotated toward the direction of the identification portion 20, i.e., in the counterclockwise direction, so as to unlock or detach the workpiece. On the contrary, when the identification portion 20 is located at the bottom edge of the handle 10, the handle 10 may be rotated toward the direction of the identification portion 20, i.e., in the clockwise direction, so as to lock the workpiece.

Thus, when the user holds the handle 10 of the single-direction operation type ratchet wrench structure, he may directly identify the direction of operation for locking or unlocking the workpiece through tactile touch based on the identification portion 20 on the handle 10, without having to test the direction of operation for locking or unlocking the workpiece, thereby facilitating the user operating the handle 10 of the single-direction operation type ratchet wrench structure.

Figure 2:
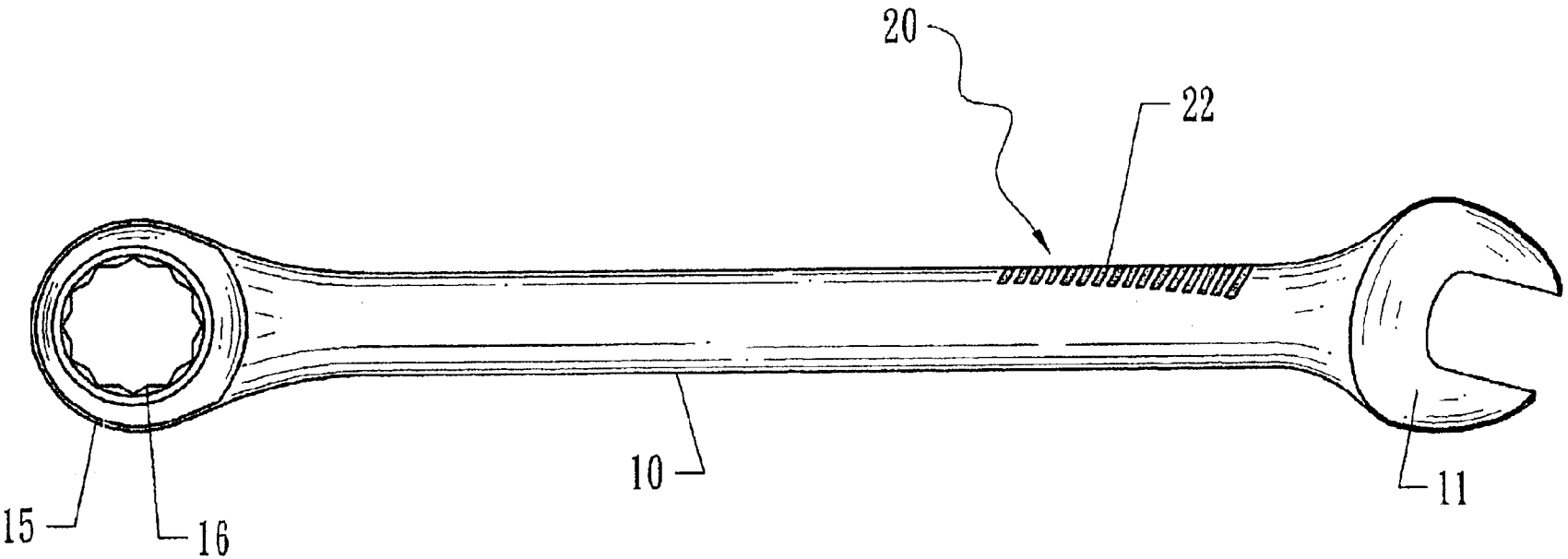
FIG. 2 is a plan view of a single-direction operation type ratchet wrench structure in accordance with a second embodiment of the present invention.

As shown in FIG. 2, the identification portion 20 includes multiple serially arranged lower oblique streaks 22 each directed toward the direction of the socket end 15 of the handle 10.

Figure 3:
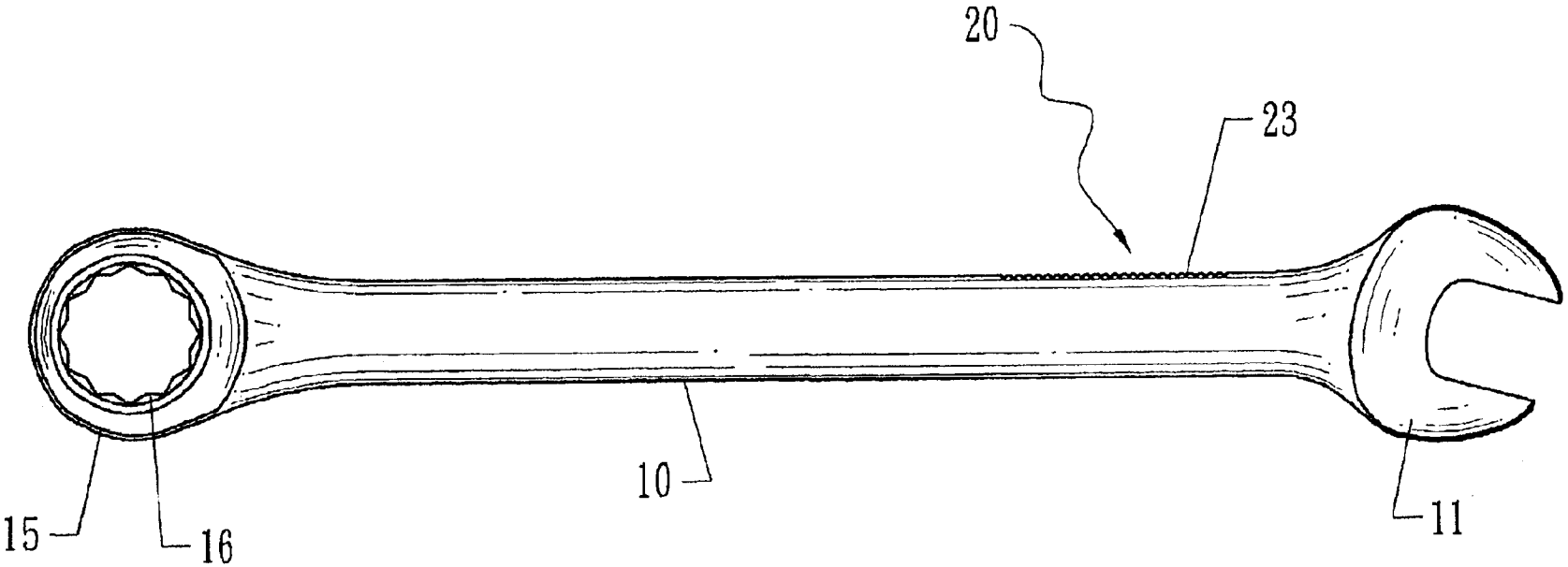
FIG. 3 is a plan view of a single-direction operation type ratchet wrench structure in accordance with a third embodiment of the present invention.

As shown in FIG. 3, the identification portion 20 includes multiple serially arranged serrated teeth 23 formed on a side end face of the handle 10, thereby increasing the user's touch sensation.

Figure 4:
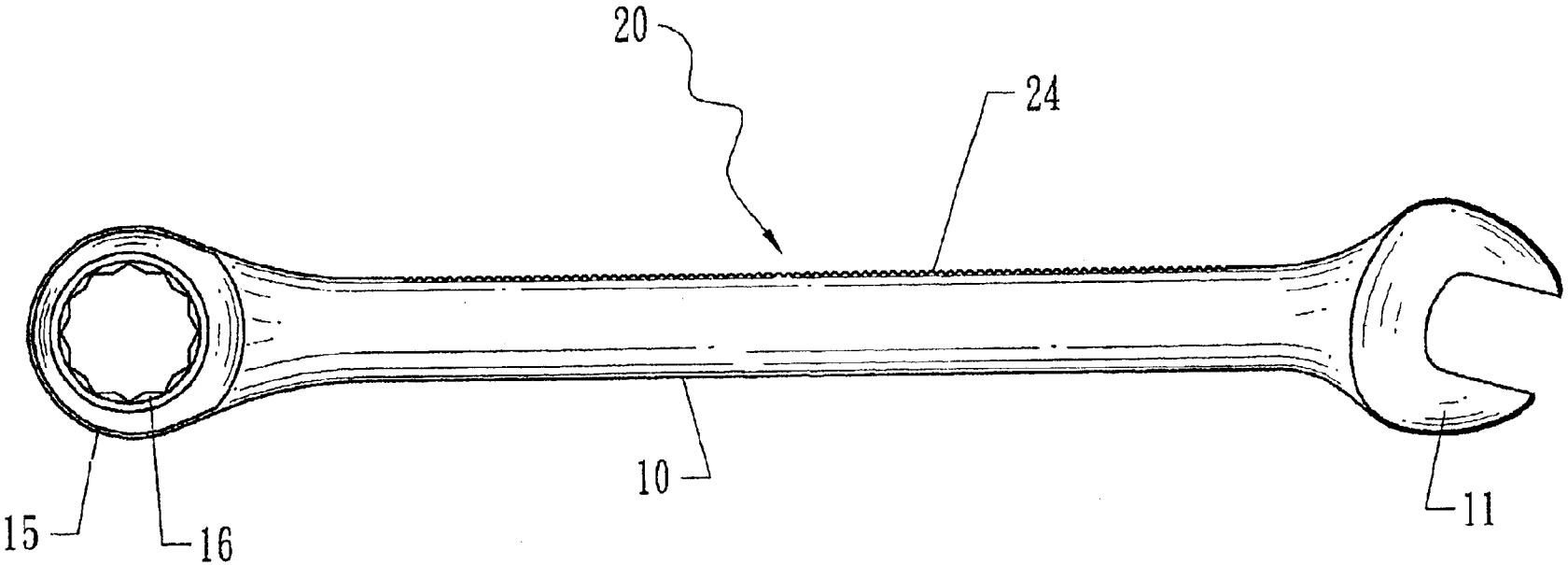
FIG. 4 is a plan view of a single-direction operation type ratchet wrench structure in accordance with a fourth embodiment of the present invention.

As shown in FIG. 4, the serrated teeth 24 of the identification portion 20 are distributed along the entire side end face of the handle 10, thereby increasing the user's touch sensation.

Figure 5:
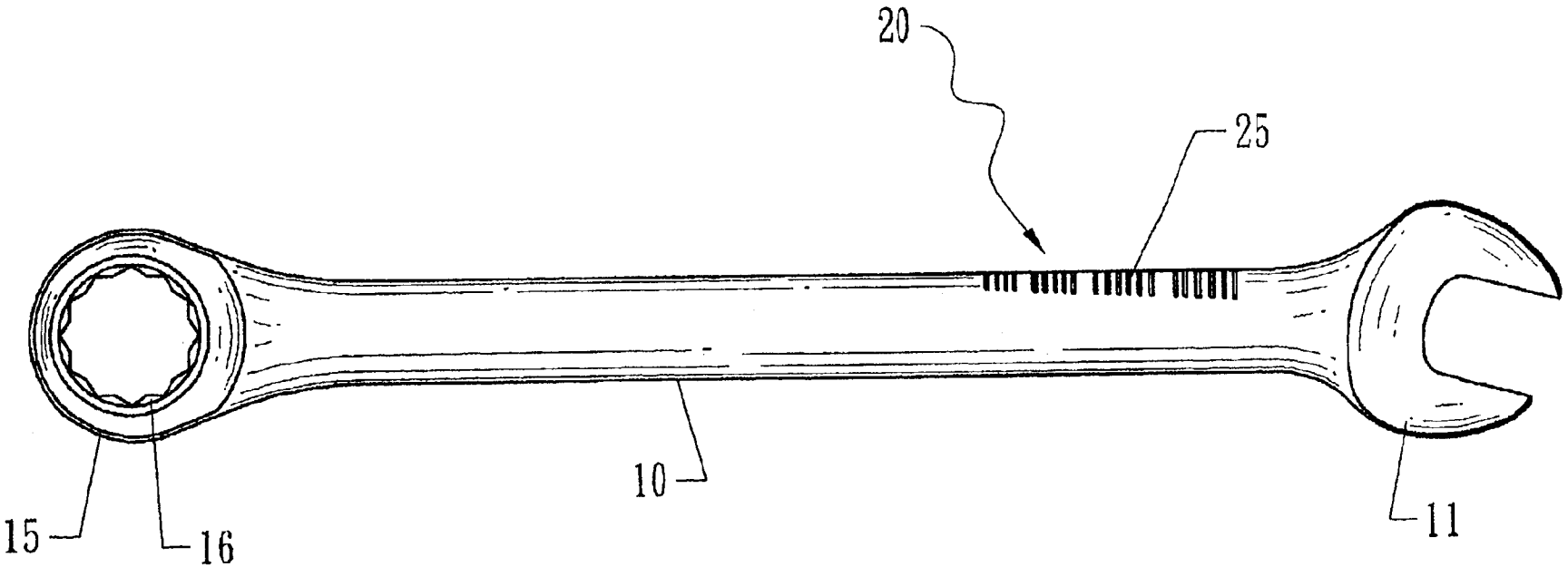
FIG. 5 is a plan view of a single-direction operation type ratchet wrench structure in accordance with a fifth embodiment of the present invention.

As shown in FIG. 5, the identification portion 20 includes multiple intermittently arranged oblique streaks 25 formed on a side edge of the handle 10, thereby increasing the user's touch sensation.

Figure 6:
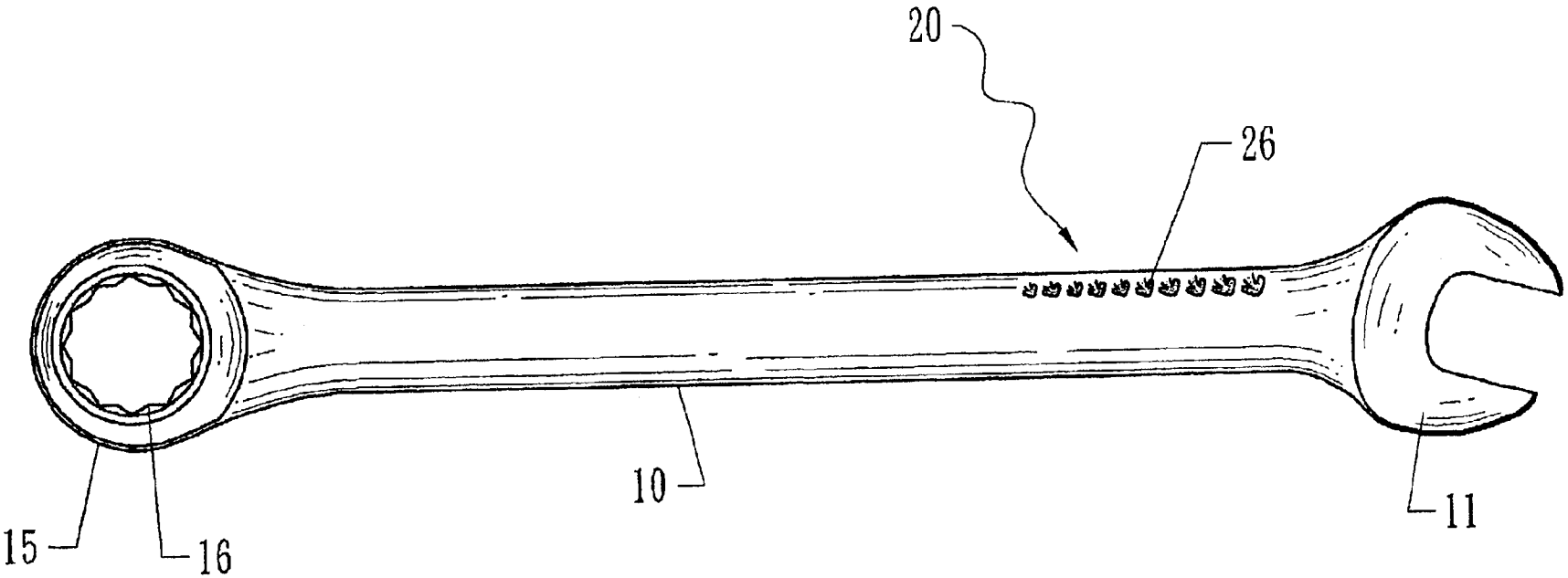
FIG. 6 is a plan view of a single-direction operation type ratchet wrench structure in accordance with a sixth embodiment of the present invention.

As shown in FIG. 6, the identification portion 20 includes multiple serially arranged arrow-shaped streaks 26 formed on a side edge of the handle 10, thereby increasing aesthetic quality of the single-direction operation type ratchet wrench structure.

Figure 7:
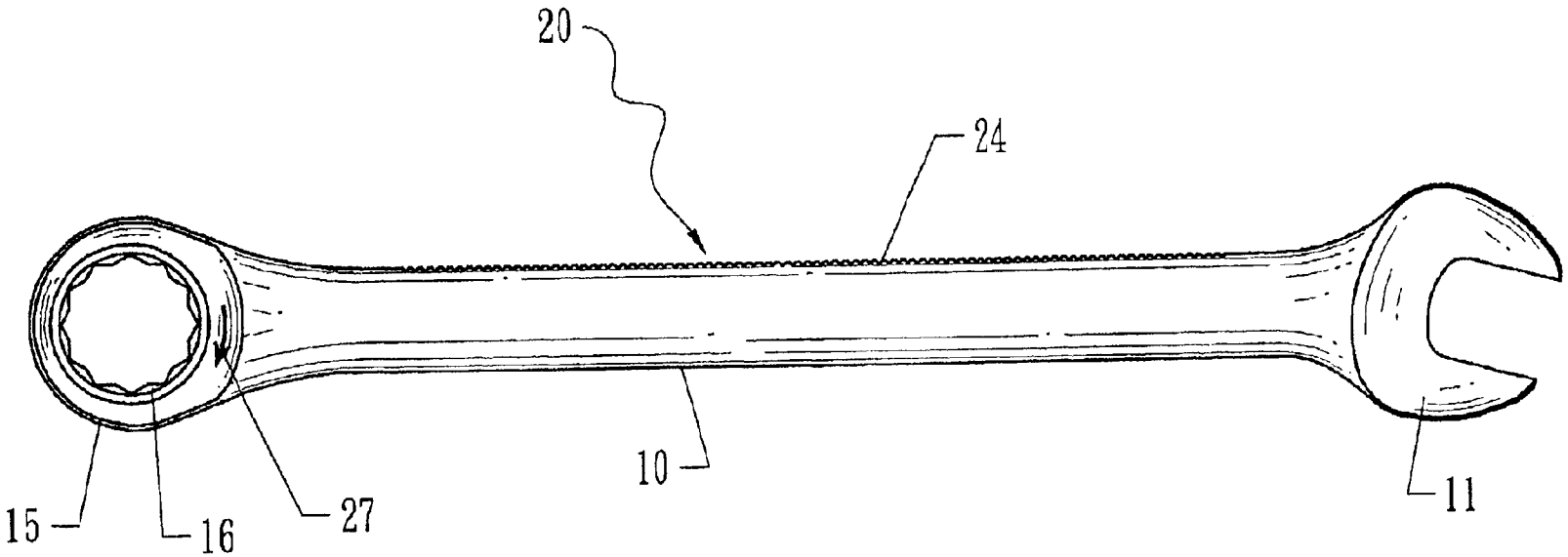
FIG. 7 is a plan view of a single-direction operation type ratchet wrench structure in accordance with a seventh embodiment of the present invention.

As shown in FIG. 7, the serrated teeth 24 of the identification portion 20 are distributed along the entire side end face of the handle 10, thereby increasing the user's touch sensation. In addition, the identification portion 20 includes an arrow-shaped streak 27 formed on the surface of the socket end 15 of the handle 10, thereby facilitating the user identifying the direction of operation of the socket end 15 of the handle 10.

Figure 8:
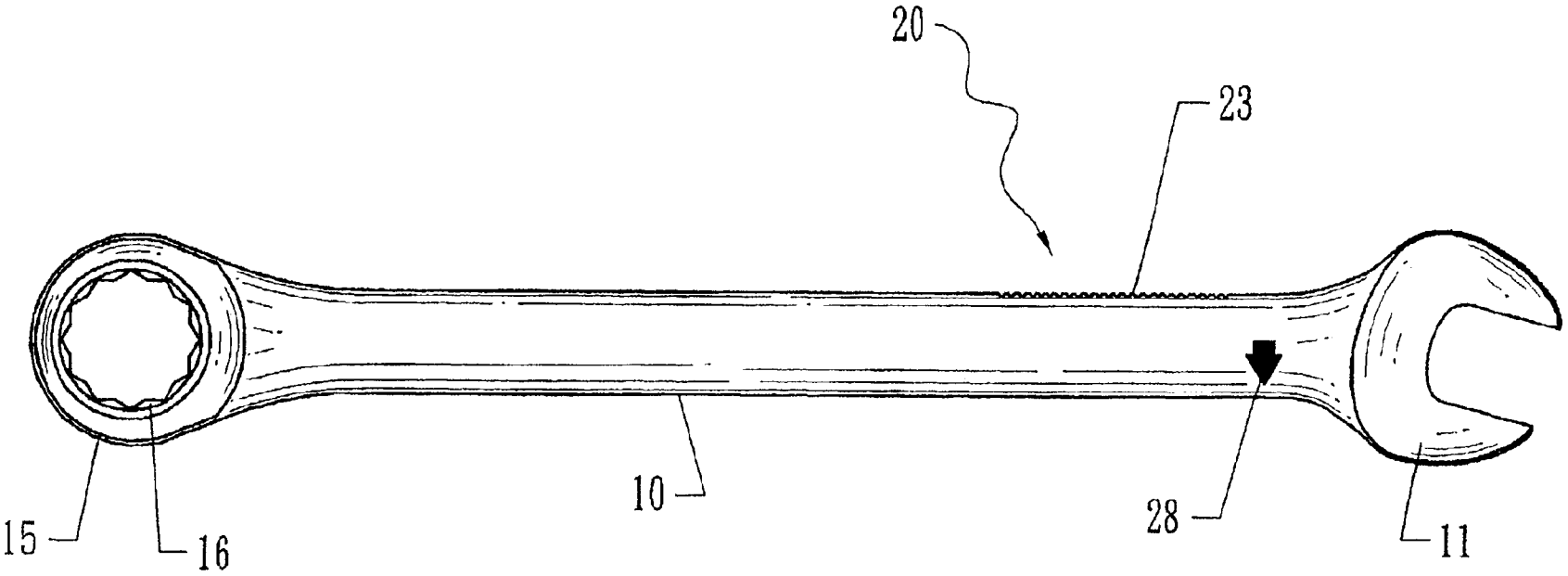
FIG. 8 is a plan view of a single-direction operation type ratchet wrench structure in accordance with a eighth embodiment of the present invention.

As shown in FIG. 8, the identification portion 20 includes multiple serially arranged serrated teeth 23 formed on a side end face of the handle 10, thereby increasing the user's touch sensation. In addition, the identification portion 20 includes an arrow-shaped streak 28 formed on the handle 10 and located opposite to the socket end 15 of the handle 10, thereby facilitating the user identifying the direction of operation of the socket end 15 of the handle 10.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A single-direction operation type ratchet wrench structure, comprising:

an elongated handle having one end provided with a socket end, two opposite side edges, two opposite side end faces, and a ratchet wheel mounted in the socket end and rotatable in only one direction; and an identification portion mounted on the handle for identifying a rotational direction of said ratchet wrench structure for locking or unlocking a workpiece, said identification portion being formed on at least one of the side edges and the side end faces spaced from said socket end to provide a tactile identification to a user of said rotational direction of said ratchet wrench structure immediately when the user holds said elongated handle.

2. The single-direction operation type ratchet wrench structure in accordance with claim 1, wherein the identification portion is provided with concave streaks.

3. The single-direction operation type ratchet wrench structure in accordance with claim 1, wherein the identification portion is provided with convex streaks.

4. The single-direction operation type ratchet wrench structure in accordance with claim 1, wherein the identification portion is bonded on the handle.

5. The single-direction operation type ratchet wrench structure in accordance with claim 1, wherein the identification portion includes multiple serially arranged upper oblique streaks each directed toward a direction opposite to the socket end of the handle.

6. The single-direction operation type ratchet wrench structure in accordance with claim 1, wherein the identification portion includes multiple serially arranged lower oblique streaks each directed toward the direction of the socket end of the handle.

7. The single-direction operation type ratchet wrench structure in accordance with claim 1, wherein the identification portion includes multiple serially arranged serrated teeth formed on a side end face of the handle, thereby increasing the user's touch sensation.

8. The single-direction operation type ratchet wrench structure in accordance with claim 7, wherein the serrated teeth of the identification portion are distributed along the entire side end face of tile handle, thereby increasing the user's touch sensation.

9. The single-direction operation type ratchet wrench structure in accordance with claim 1, wherein the identification portion includes multiple intermittently arranged oblique streaks formed on a side edge of the handle, thereby increasing the user's touch sensation.

10. The single-direction operation type ratchet wrench structure in accordance with claim 1, wherein the identification portion includes multiple serially arranged arrow-shaped streaks formed on a side edge of the handle.

11. The single-direction operation type ratchet wrench structure in accordance with claim 7, wherein the serrated teeth of the identification portion are distributed along one entire side end face of the handle, thereby increasing the user's touch sensation, and the identification portion includes an arrow-shaped streak formed on a surface of the socket end of the handle, thereby facilitating the user identifying the direction of operation of the socket end of the handle.

12. The single-direction operation type ratchet wrench structure in accordance with claim 1, wherein the identification portion includes multiple serially arranged serrated teeth formed on one of the side end faces of the handle, thereby increasing the user's touch sensation, and the identification portion includes an arrow-shaped streak formed on the handle and located opposite to the socket end of the handle, thereby facilitating the user identifying the direction of operation of the socket end of the handle.

* * * * *